US005620354A

United States Patent [19]

Watkins

[11] Patent Number: 5,620,354

[45] **Date of Patent: *Apr. 15, 1997**

[54] STREAMERS WITH CONFETTI

[76] Inventor: James O. Watkins, 14920 Mt. Nebo Rd., Poolesville, Md. 20837

[ * ] Notice: The term of this patent shall not extend beyond the expiration date of Pat. No. 5,352,148.

[21] Appl. No.: 496,075

[22] Filed: Jun. 28, 1995

[51] Int. Cl.[6] ..... A63H 37/00

[52] U.S. Cl. ..... 446/475; 446/491

[58] Field of Search ..... 446/475, 491; 428/906

[56] References Cited

U.S. PATENT DOCUMENTS

| | | | |
|---|---|---|---|
| 1,090,778 | 3/1914 | Clark | 446/475 |
| 5,352,148 | 10/1994 | Watkins | 446/475 |
| 5,354,227 | 10/1994 | Watkins | 446/475 |
| 5,419,731 | 5/1995 | Watkins | 446/475 |

FOREIGN PATENT DOCUMENTS

| | | | |
|---|---|---|---|
| 360280 | 4/1906 | France | 446/475 |
| 341784 | 3/1930 | United Kingdom | 446/475 |

*Primary Examiner*—Mickey Yu
*Attorney, Agent, or Firm*—Ronald B. Sherer

[57] ABSTRACT

Streamers containing confetti rolled inside the streamer are disclosed in which the confetti is released from the streamer as the streamer unwinds in the air. The preferred embodiments include PVC film for the wound streamer, a soft cushioned core to enable cutting without jagged edges to impede unwinding of the streamer, and a high-slip coating on the film.

12 Claims, 2 Drawing Sheets

STREAMERS WITH CONFETTI

FIELD OF THE INVENTION

The present invention relates to streamers, and more particularly, to streamers containing confetti such that the confetti is released from the streamer as the streamer unwinds in the air.

BACKGROUND

Streamers comprising rolls of paper or tissue paper strips have long been popular amusement devices at conventions, celebrations and sporting events where the participants throw the streamers and they fly through the air in the form of comets with long tails which progressively unwind from the rolls. Suggestions have been made to manufacture such streamers from Mylar brand plastic film. However, such film poses a fire hazard in crowds because it is flammable, and it also poses a risk of injury in that such film has a relatively high tensile strength which can trip a person if entwined about the feet, or even choke a person if entwined about the neck. In addition, streamers alone lack the high degree of visual appeal which can be produced by a large plurality of falling pieces of confetti since the eye sees only one object when a streamer flies through the air.

The present invention provides a streamer, which also contains confetti, so that the eye sees multiple objects in the air, and the present invention provides for the use of plastic film in a unique manner which avoids all of the above-indicated objections. In addition, the present invention provides a streamer which produces a display of confetti which remarkably simulates softly falling snowflakes as the confetti pieces are released by the streamer unwinding in the air.

These and other objects and advantages will become apparent from the following description of several preferred embodiments of the invention as illustrated in the following drawings.

DETAILED DESCRIPTION

One embodiment of the streamer and its mode of operation will be described first with reference to FIGS. 1–3, followed by a description of one preferred method of manufacture of the streamer with reference to FIG. 4, followed by a description of a second embodiment of the streamer. Numeral 10 designates the manufactured streamer which is a roll of plastic film 11 with a large plurality of confetti pieces rolled inside. Preferably, streamer 10 is a roll of metalized PVC film, as opposed to other plastic films, since PVC film is flameproof. While a standard film thickness of 1.4 mils may be used, it has been discovered that markedly superior results are obtained with a film thickness in the order of 0.8 mils, and that the use of a high-slip coating, such as Sun-Slip brand coating, further improves the unwinding action of the streamer as it flies through the air.

It has also been discovered that the size of the streamer, in terms of its width and diameter, are important factors in the overall performance. For example, it has been discovered that the width of the streamer has a substantial effect on the ability of the streamer to unroll rapidly and completely. More specifically, it has been discovered that the width of the streamer should be in the order of 0.25 to 0.6 inches with a preferred width in the order of 0.3 to 0.5 inches. Within this range, and with a PVC film in the order of 0.8 mils thick, it has been discovered that the streamer unwinds rapidly and essentially completely in the air. Also, with the film in the order of 0.25 to 0.6 inches wide and only 0.8 mils thick, the film breaks very easily such that the spent film does not pose a risk of tripping or choking a person before it is easily picked up and discarded.

With respect to the diameter, it has been found that a streamer for hand throwing should preferably have a length in the order of 12 to 20 feet such that, for a streamer composed of metalized PVC film having a thickness in the order of 0.8 mils, and with the pieces of confetti wrapped therein, the preferred diameter of the streamer is in the order of 0.4 to 1.0 inches, and preferably in the order of 0.5 to 0.875 inches.

Figure 1:
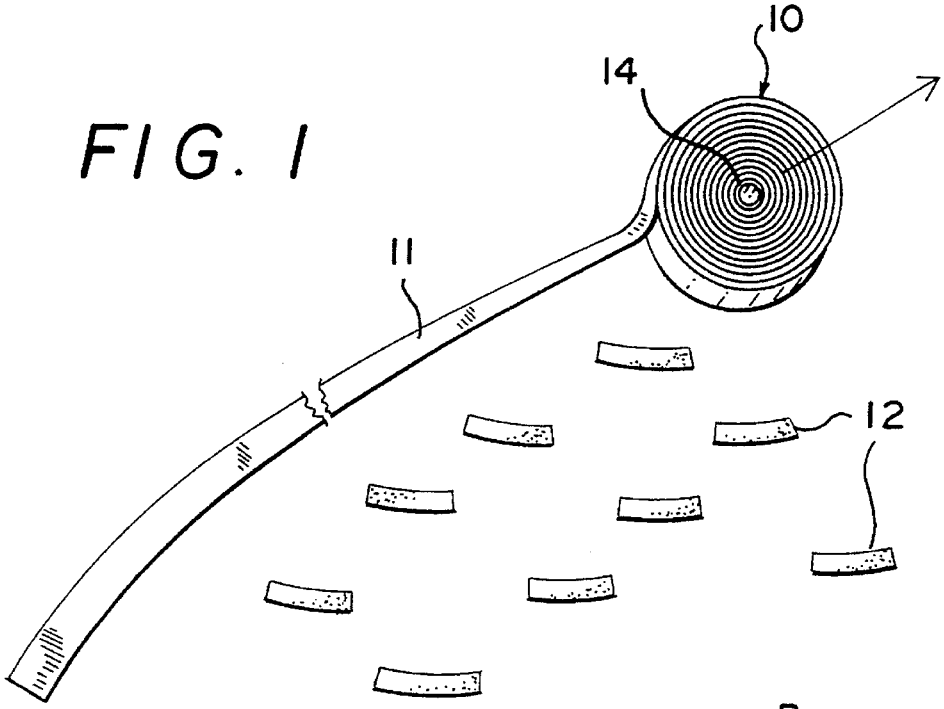
FIG. 1 is a simplified perspective view of a streamer of the present invention flying through the air and releasing confetti in a simulated snowstorm.

As previously indicated and shown in FIG. 1, streamer 10 includes a large plurality of pieces of confetti which are indicated by numeral 12. Confetti pieces 12 are wrapped between the wound layers of the streamer, as will be more fully described hereafter, such that, as the streamer unwinds in the air, the confetti pieces are progressively released from the streamer. In order to provide the visual effect of softly falling snow, the size and shape of the confetti pieces have been found to be critical. For example, it as been found that fireproof and biodegradable tissue paper of 8–15 pound test performs best in simulating a snowfall, although paper, and alternate layers of tissue paper and plastic film may be used as will be further described hereinafter. With respect to the shape, each piece of confetti is four-sided, and preferably rectangular, and the length of each piece is in the order of 0.75 to 1.25 inches. The width of each piece of confetti is the same as the width of the streamer, which as previously stated, is in the order of 0.25 to 0.6 inches, and preferably in the order of 0.3 to 0.5 inches. Within these preferred lengths and widths, it has been discovered that each piece of confetti falls through the air with a particular tumbling motion which slows the rate of descent through the air such that the combined effect remarkably resembles softly falling snowflakes.

Figure 2:
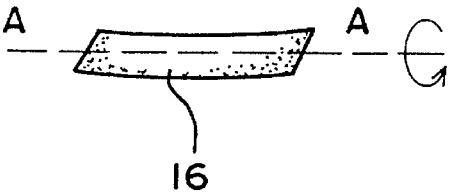
FIG. 2 is an elevational view showing the motion of one piece of confetti as it falls through the air.
Figure 3:
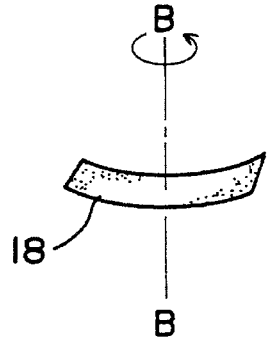
FIG. 3 is an elevational view showing the motion of another piece of confetti of different shape as it falls through the air.
Figure 4:
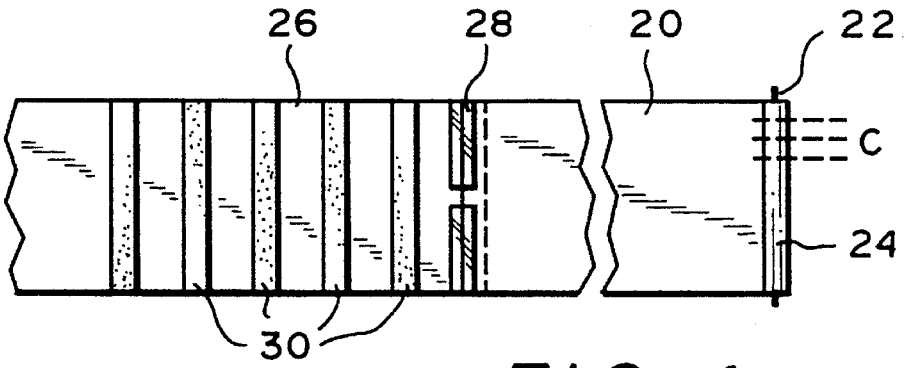
FIG. 4 is a schematic illustration of one preferred method of manufacture of the streamers of the present invention.

It should also be noted that, as shown in FIGS. 2 and 3, the curvature of a piece of confetti falling out of the unwinding streamer is different depending upon the radial distance of that piece from the core 14 of the streamer. For example, confetti piece 16 shown in FIG. 2 is less curved than piece 18 shown in FIG. 3. This is because piece 16 was located a greater radial distance from the core than piece 18 and, therefore, piece 16 became less permanently curved while located in the streamer. This difference in the degree of curvature of the pieces of confetti has been discovered to have a surprising difference in the aerodynamics of the confetti pieces. For example, pieces of confetti having a relatively slight curvature, such as piece 16, rotate about their longitudinal axes A—A and the longitudinal axes remain essentially horizontal as the pieces fall through the air. While this aerodynamic effect is described with respect to flat or planar pieces of confetti in U.S. Pat. No. 5,352,148, the complete disclosure of which is hereby incorporated by reference, it was not previously known that this aerodynamic motion could be achieved with non-flat, curved pieces as described herein. In addition, it has been discovered that, as the streamer continues to unwind and pieces of confetti closer to the core fall from the streamer, these more curved pieces, such as piece 18, do not fall with a rotating motion about their horizontal axes. Instead, they fall through the air with their convex sides remaining facing downwardly, and their concave sides remaining facing upwardly, and the majority of these more curved pieces twirl slowly about their vertical axes B—B thereby adding a second type of aerodynamic motion. This produces a unique overall visual image with some of the pieces rotating about their horizontally extending longitudinal axes, and other pieces twirling in the horizontal plane about their vertical axes. This produces an exceptionally realistic looking snowstorm of fluttering, twirling and slowly falling snowflakes.

One preferred method of manufacture will now be described with reference to FIG. 4. One or more sheets of tissue paper 20 are first wound about a removable winding stick 22 to form a soft core 24 of tissue paper. For example, the tissue paper may be wrapped about the stick such that 8–60 inches of tissue paper comprise the core. At the trailing edge of tissue paper 20, the leading edge of the metalized PVC film 26 is secured such as by pieces of adhesive tape 28, or merely overlapping the film over the tissue paper and winding the overlapped layers into the roll. Narrow strips of tissue paper 30 are then laid on top of the PVC film and the strips are wound into the roll between the layers thereof as the PVC film continues to be wound about the core. The lengths of strips 30 are preferably the same as the width of the PVC film, which may be 30 inches, for example, and the widths of strips 30 are preferably in the order of 0.75 to 1.25 inches as previously described. The strips of tissue paper 30 are shown in FIG. 4 as being spaced apart along the length of the PVC film for purposes of clarity. However, it is to be understood that the tissue paper strips may be butted together, or overlapped, or stacked in multiple layers where it is desired to provide more confetti pieces in a streamer of a given length. For example, it has been found that the number of confetti pieces, and therefore the number of tissue paper strips, should be in the order of 40 to 100 for a hand-thrown streamer. Alternatively, 75 to 200 pieces may be provided when the streamer is to be launched from a compressed gas cannon. It has also been found that the amount of tissue paper strips in the completed streamer should comprise at least 40% of the total diameter of the streamer. This amount of tissue paper provides a necessary amount of cushioning and resiliency such that a clean cut may be made, as will be further described, and also makes the streamer pliable and relatively soft so as to prevent injury.

Once the complete length of the PVC film has been wound about the core with the tissue paper strips wound therein, the winding stick is removed by pulling it out from the center of the tissue paper core, and the trailing edge of the PVC film is lightly taped to the roll to prevent unwinding. The wound roll is then placed in a cutting machine, and the elongated roll is cut perpendicular to the longitudinal axis of the roll as indicated by cut lines C to produce individual streamers having widths as previously described. Because of the tissue paper layers, the PVC film may be cut with clean edges which are not jagged or fused together which otherwise occurs with plastic film and prevents the streamer from unrolling smoothly or completely.

Figure 7:
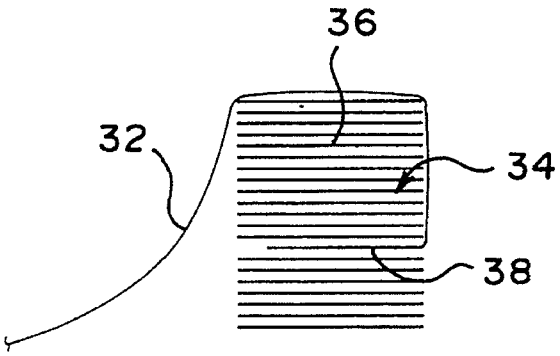
FIG. 7 is an enlarged, cross-sectional view of a stack of tissue paper strips being wound into the streamer of FIG. 5.

A second preferred embodiment will now be described with reference to FIGS. 5–7. In this embodiment, streamer 10' is composed of a wound strip of plastic film 32, and preferably metalized PVC film of the preferred thickness previously described; the preferred dimensions of width and diameter of the streamer also being as previously described. However, instead of winding the confetti pieces into the streamer between wound layers of the film, the film 32 is wound about a stack 34 of narrow tissue paper strips 36. This may be facilitated by inserting the end edge 38 of the film between upper and lower portions of the stack, as shown in FIG. 7, and then rotating the stack about its longitudinal axis. In effect, stack 34 acts as stick 22 of the first embodiment; however, stack 34 is not removed upon completion of wrapping the elongated roll.

The elongated roll is then cut transverse to its longitudinal axis, as previously described, such that the individual streamers are formed with the confetti pieces at the center of the streamer instead of dispersed throughout the streamer. Of course, it will be understood that the widths of strips 36 become the lengths of the confetti pieces, and the widths of the confetti pieces are that of the widths of the cut streamers, and that these dimensions are as previously described. This second embodiment has several advantages in that, for example, the manufacturing process is quicker, and therefore less costly. Also, the confetti pieces do not become curved as previously described such that they all rotate about their longitudinal axes, all of which axes remain horizontal as they fall through the air. In addition, the visual effect is different in that all of the confetti pieces are released at once, upon completion of the unwinding of the streamer in the air, such that a sudden burst, or sudden shower effect, is achieved. Of course, the slow and fluttering descent of the pieces, which appear as softly falling snowflakes, is the same as the previously described with reference to FIG. 2.

Figure 5:
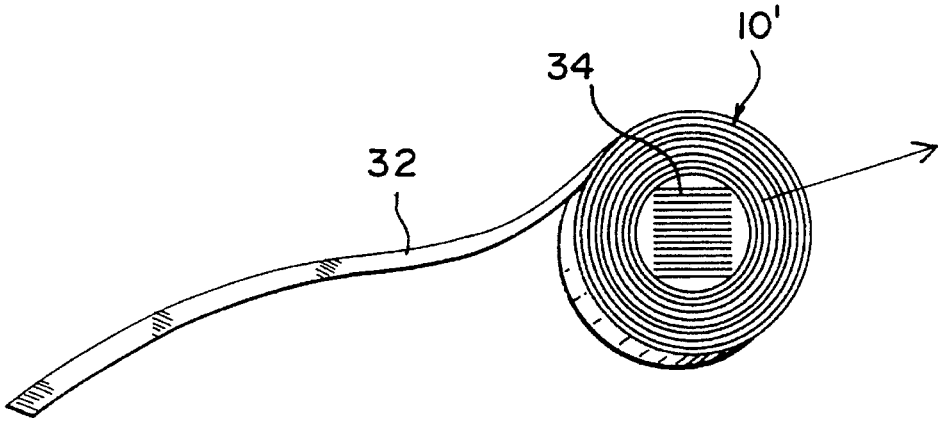
FIG. 5 is a simplified perspective view of a second embodiment of the streamer of the present invention.
Figure 6:
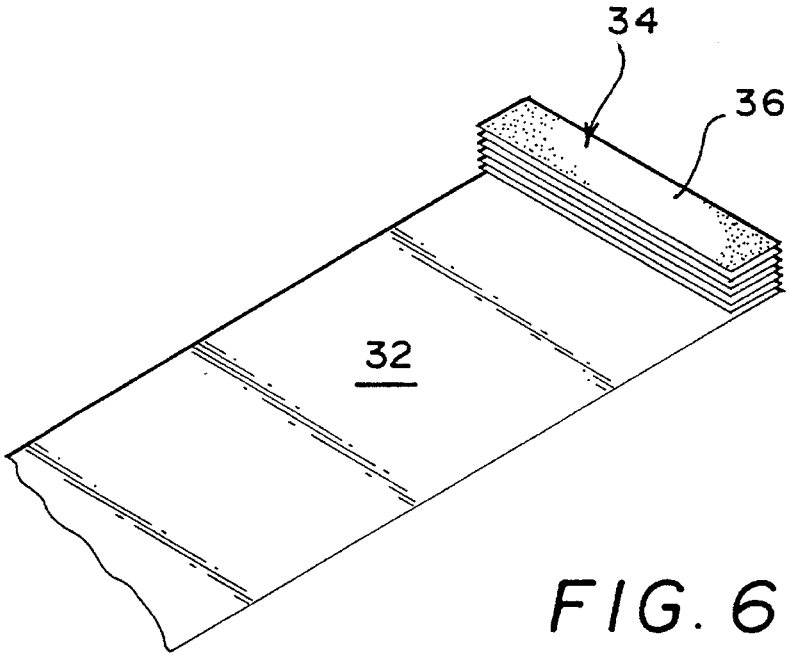
FIG. 6 is a simplified perspective view showing one preferred method of manufacture of the streamer of the FIG. 5 embodiment.

In the foregoing description, it has been stated that strips 30 in the FIG. 1–4 embodiment, and strips 36 in the FIG. 5–7 embodiment, may be composed of tissue paper, and preferably white tissue paper in order to simulate the snowflakes. Alternatively, strips 30 and 36 may be stacks of alternate layers of tissue paper and metalized PVC film, such as silver metalized film for example, whereby the resultant confetti pieces are a combination of white and shiny silver pieces which give an ice and snow effect as they rotate, twirl and slowly fall to the ground. Of course, other colors may also be used to simulate other effects, such as fireworks.

From the foregoing description of several preferred embodiments of the present invention, it will be understood that streamers of the present invention have markedly improved and unexpected characteristics including, for example, the ability to unroll completely in the air when hand-thrown, as well as the unexpected capability of creating a visual display which realistically appears as a large plurality of slowly and softly falling snowflakes. In addition, both the streamer and the confetti are fireproof, and the streamer poses no danger of injury because of its exceptionally frangible property. Of course, other embodiments and variations of the illustrated embodiments will become apparent to those skilled in the art. Therefore, it is to be understood that the foregoing description is intended to be purely illustrative of the principles of the invention, rather than limiting thereof, and that the legal scope of the invention is not intended to be limited other than as set forth in the following claims interpreted under the doctrine of equivalents.

What is claimed is:

1. A streamer for producing a visual display comprising:

(a) a core of soft material;

(b) a roll of wound layers of plastic film surrounding said core;

(c) said film being composed of PVC film;

(d) a large plurality of pieces of confetti contained between said wound layers of plastic film, at least some of said pieces of confetti being composed of tissue paper; and (e) said wound layers of plastic film being coated with a high-slip coating such that said roll unwinds smoothly and said confetti pieces are released from the roll as the streamer unwinds in the air.

2. The streamer of claim 1 wherein the width of the streamer is in the order of 0.25 to 0.6 inches.

3. The streamer of claim 1 wherein the thickness of said PVC film is less than 1.4 mil.

4. The streamer of claim 1 wherein the thickness of said PVC film is in the order of 0.8 mils.

5. The streamer of claim 1 wherein some of said pieces of confetti are comprised of tissue paper and others of said pieces of confetti are comprised of metalized plastic film.

6. The streamer of claim 1 wherein said core of soft material comprises wound layers of tissue paper.

7. A streamer for producing a burst of falling confetti comprising in combination:

(a) a core comprising a plurality of four-sided pieces of confetti, each of said pieces of confetti having a length, a width and a pair of faces, said plurality of pieces of confetti being stacked in face-to-face relationship with said lengths aligned with each other to form said core;

(b) at least some of said pieces of confetti being composed of tissue paper such as to form a soft core;

(c) a roll of wound layers of plastic film surrounding said core, said plastic film being composed of PVC film; and (d) said wound layers of PVC film being coated with a high-slip coating such that said roll unwinds smoothly and said confetti pieces are released from the roll in a burst when the roll fully unwinds in the air.

8. The streamer of claim 7 wherein said film has a thickness of less than 1.4 mils and a width in the order of 0.25 to 0.6 inches.

9. The streamer of claim 7 wherein said stack of confetti pieces comprises first and second portions and wherein one end of said strip of PVC film is positioned in said stack between said first and second portions thereof.

10. The streamer of claim 7 wherein some of said plurality of pieces of confetti are composed of tissue paper and some of said pieces are composed of metalized plastic film.

11. The streamer of claim 7 wherein said lengths are in the order of 0.75 to 1.25 inches and said widths are in the order of 0.25 to 0.6 inches.

12. The streamer of claim 7 wherein said PVC film is metalized PVC film.

* * * * *